US011067361B2

(12) United States Patent
Keller et al.

(10) Patent No.: US 11,067,361 B2
(45) **Date of Patent: *Jul. 20, 2021**

(54) STOCK ASSEMBLY SYSTEMS WITH MATING INTERFACES

(71) Applicant: Strike Industries, Inc., Santa Ana, CA (US)

(72) Inventors: Garrett O'Neill Keller, Santa Ana, CA (US); David Hyung Chin, Irvine, CA (US)

(73) Assignee: Strike Industries, Inc., Santa Ana, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/009,511

(22) Filed: Sep. 1, 2020

(65) Prior Publication Data

US 2020/0400404 A1 Dec. 24, 2020

Related U.S. Application Data

(63) Continuation of application No. 16/050,111, filed on Jul. 31, 2018, now Pat. No. 10,794,662.

(60) Provisional application No. 62/540,011, filed on Aug. 1, 2017.

(51) Int. Cl.
*F41C 23/14* (2006.01)
*F41C 23/04* (2006.01)

(52) U.S. Cl.
CPC ..... *F41C 23/14* (2013.01); *F41C 23/04* (2013.01)

(58) Field of Classification Search
CPC ..... F41C 23/14; F41C 23/04
See application file for complete search history.

(56) References Cited

U.S. PATENT DOCUMENTS

| | | | | |
|---|---|---|---|---|
| 10,794,662 | B2 * | 10/2020 | Keller | F41C 23/14 |
| 2010/0186276 | A1 * | 7/2010 | Herring | F41C 23/04 42/6 |
| 2019/0063869 | A1 * | 2/2019 | Keller | F41C 23/10 |
| 2020/0200505 | A1 * | 6/2020 | Brown, Jr. | F41C 23/14 |

* cited by examiner

*Primary Examiner* — J. Woodrow Eldred
(74) *Attorney, Agent, or Firm* — Andy M. Han; Han IP PLLC

(57) ABSTRACT

Adjusting the length of firearms using stock assembly systems are provided. In one embodiment, a stock assembly comprises: a receiver extension having a first interface configured to mate with a second interface of a stock; the first interface comprising a base portion, a plurality of first edges, and a plurality of first grooves; the second interface comprising a slot portion, a plurality of second edges, and a plurality of second grooves; wherein the plurality of first edges are in contact with the plurality of second grooves and the plurality of first grooves are in contact with the plurality of second edges of the second interface to mate the stock with the receiver extension; and wherein the base portion of the first interface is in contact with the slot portion of the second interface allowing the stock to slide along a horizontal axis of the receiver extension.

20 Claims, 9 Drawing Sheets

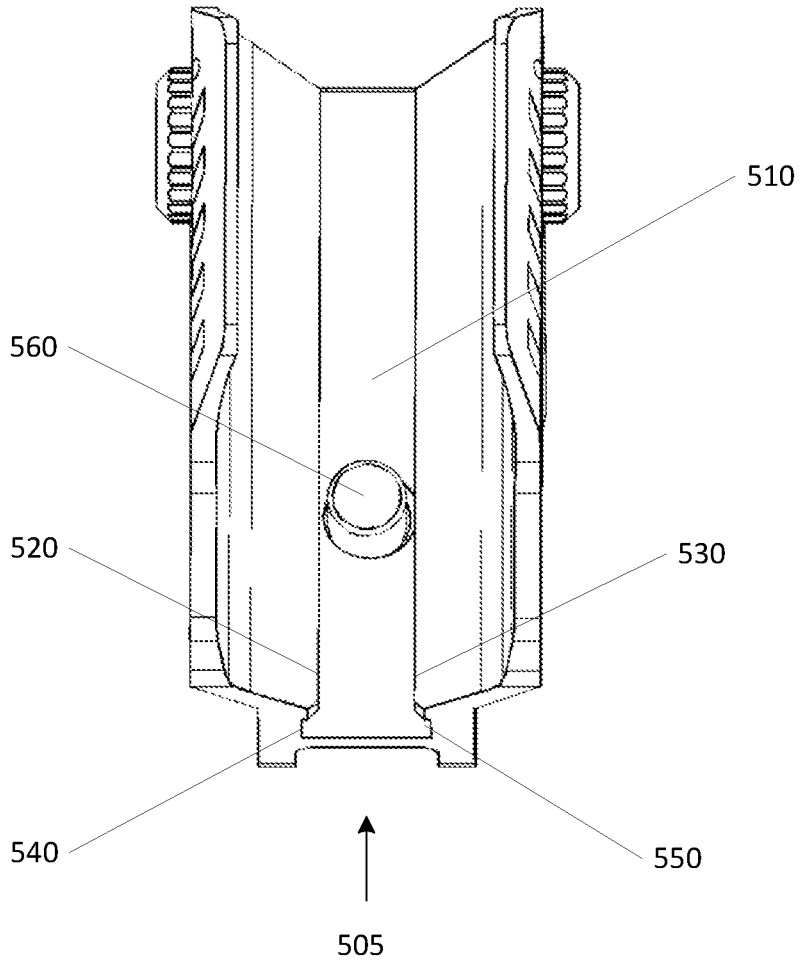
FIG. 5
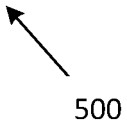

600

STOCK ASSEMBLY SYSTEMS WITH MATING INTERFACES

CROSS REFERENCE TO RELATED PATENT APPLICATIONS

The present disclosure is part of a continuation of U.S. patent application Ser. No. 16/050,111, filed 31 Jul. 2018, which claims the priority benefit of U.S. Patent Application No. 62/540,011, filed 1 Aug. 2017. Contents of above-listed applications are herein incorporated by reference in their entirety.

TECHNICAL FIELD

The present invention generally relates to firearms and more specifically to stock assemblies with mating interfaces for changing firearm lengths.

BACKGROUND

Typically, firearms are a standard length having particular sized components. Further, the length of the firearm may have a significant impact on the performance and accuracy of the firearm. For example, a rifle is designed to be fired from the shoulder such that the stock of the rifle is braced against the shoulder of the shooter when firing. Since the anatomy of different shooters may vary greatly, one standard length may not suffice. One way to change the length of a rifle may be to simply change out the standard issue stock for a shorter or longer stock. Further, some rifles may include a stock that is either fixed or foldable, the latter allowing for easier storage and transportation of the firearm.

SUMMARY

The various embodiments of the present stock assemblies have several features, no single one of which is solely responsible for their desirable attributes. Without limiting the scope of the present embodiments, their more prominent features will now be discussed below. After considering this discussion, and particularly after reading the section entitled "Detailed Description," one will understand how the features of the present embodiments provide the advantages described here.

One aspect of the present embodiments includes the realization that, in current stock and receiver extension combinations other than the present embodiments, the length of the firearm may be extended using a telescoping mechanism where a hollow interior cavity of the stock must be exactly made in relation to the exterior diameter of the receiver extension. Since the hollow interior cavity of the stock allows the stock to slide and stay attached to the receiver extension, any discrepancies in the diameter of the interior cavity of the stock or the external diameter of the receiver extension would negatively impact performance. For example, if the diameter of the interior cavity of the stock is too small relative to the external diameter of the receiver extension, then there may be friction and "sticking" when adjusting the length of the firearm. On the other hand, if the diameter of the stock's interior cavity is too large, then the stock may be loosely secured adding unwanted movement and thus negatively impacting performance. Therefore, there is a need in the firearms industry for improved stock assembly systems that allow for changes in firearm lengths with increased stability.

Stock assembly systems with mating interfaces may enable improvements over prior art telescoping stocks such as (but not limited to) a more secure affixing of a stock to a receiver extension, reduced weight, improved area of interface between stock and receiver extension, reduced cost, reduced overall size, increased simplicity, improved ergonomics, and tighter part tolerances due to increased ease of manufacture. For instance, some embodiments can be produced using an extrusion manufacturing technique whereby components are produced by forcing blank material through particularly shaped dies. Extrusion produced components can yield reduced brittleness, increased hardness, and overall improved durability while being less costly to manufacture. While many improvements over prior techniques can be enabled by embodiments of the invention, exemplary lists of advantages and/or improvements for embodiments of the invention should not be interpreted as exhaustive.

In a first aspect, a stock assembly for adjusting a length of a firearm is provided, the stock assembly comprising: a receiver extension having a connecting portion configured to attach to a firearm and a first interface configured to mate with a second interface of a stock; the first interface of the receiver extension comprising a base portion having at least one position hole, a plurality of first edges, and a plurality of first grooves; the second interface of the stock comprising a slot portion having an adjustment pin having a first position and a second position, a plurality of second edges, and a plurality of second grooves; wherein the plurality of first edges of the first interface are in contact with the plurality of second grooves of the second interface and the plurality of first grooves of the first interface are in contact with the plurality of second edges of the second interface to mate the stock with the receiver extension; wherein the base portion of the first interface is in contact with the slot portion of the second interface allowing the stock to slide along a horizontal axis of the receiver extension; wherein the first position of the adjustment pin allows the stock to slide along the horizontal axis of the receiver extension to adjust the length of the firearm; and wherein the second position of the adjustment pin inserts the adjustment pin into the at least one position hole to lock the stock along the horizontal axis of the receiver extension to fix the length of the firearm.

In an embodiment of the first aspect, the connecting portion of the receiver extension is a threading portion that allows the receiver extension to be threaded with a corresponding threading portion of the firearm.

In another embodiment of the first aspect, the receiver extension is hollow to allow recoil springs to move during a cycling of the firearm.

In another embodiment of the first aspect, the receiver extension includes an extension end portion positioned opposite the connecting portion, wherein the extension end portion includes at least one opening.

In another embodiment of the first aspect, the adjustment pin may be placed into the first position or the second position using an adjustment lever.

In another embodiment of the first aspect, depressing the adjustment lever places the adjustment pin into the first position and releasing the adjustment lever places the adjustment pin into the second position.

In another embodiment of the first aspect, the adjustment lever includes at least one spring.

In another embodiment of the first aspect, the stock assembly is made of a polymer material.

In another embodiment of the first aspect, the at least one position hole includes a first position hole and a second position hole that correspond to different lengths of the firearm.

In another embodiment of the first aspect, the base portion and first edges of the first interface form an inverted T shape rail.

In another embodiment of the first aspect, the first interface and the second interface are created using an extrusion manufacturing process.

In another embodiment of the first aspect, the plurality of first edges of the first interface in contact with the plurality of second grooves of the second interface and the plurality of first grooves of the first interface in contact with the plurality of second edges of the second interface lock the first and second interfaces preventing the stock from moving about a radial axis of the receiver extension.

In another embodiment of the first aspect, the stock further comprises a first receiving wall and a second receiving wall that receives a body portion of the receiver extension.

In another embodiment of the first aspect, the first receiving wall and the second receiving wall expose a top portion creating an interior cavity of the stock that does not fully enclose the receiver extension.

In another embodiment of the first aspect, the stock further comprises a stock buttplate to cushion the stock when pressed again a shooter's shoulder.

In another embodiment of the first aspect, the at least one position hole includes five position holes.

In another embodiment of the first aspect, the at least one position hole includes seven position holes.

In a second aspect, a method for adjusting a length of a firearm using a stock assembly is provided, the method comprising: attaching a receiver extension having a connecting portion to a firearm; mating a first interface of the receiver extension with a second interface of a stock, wherein: the first interface of the receiver extension comprises a base portion having at least one position hole, a plurality of first edges, and a plurality of first grooves; and the second interface of the stock comprises a slot portion having an adjustment pin having a first position and a second position, a plurality of second edges, and a plurality of second grooves; mating the stock with the receiver extension, wherein the plurality of first edges of the first interface are in contact with the plurality of second grooves of the second interface and the plurality of first grooves of the first interface are in contact with the plurality of second edges of the second interface; sliding the stock along a horizontal axis of the receiver extension, wherein the base portion of the first interface is in contact with the slot portion of the second interface allowing the stock to slide along the horizontal axis of the receiver extension; adjusting the length of the firearm, wherein the first position of the adjustment pin allows the stock to slide along the horizontal axis of the receiver extension; and fixing the length of the firearm, wherein the second position of the adjustment pin inserts the adjustment pin into the at least one position hole to lock the stock along the horizontal axis of the receiver extension fix the length of the firearm.

In an embodiment of the second aspect, the connecting portion of the receiver extension is a threading portion that allows the receiver extension to be threaded with a corresponding threading portion of the firearm.

In another embodiment of the second aspect, the receiver extension is hollow to allow recoil springs to move during a cycling of the firearm.

In another embodiment of the second aspect, the receiver extension includes an extension end portion positioned opposite the connecting portion, wherein the extension end portion includes at least one opening.

In another embodiment of the second aspect, the adjustment pin may be placed into the first position or the second position using an adjustment lever.

In another embodiment of the second aspect, depressing the adjustment lever places the adjustment pin into the first position and releasing the adjustment lever places the adjustment pin into the second position.

In another embodiment of the second aspect, the adjustment lever includes at least one spring.

In another embodiment of the second aspect, the stock assembly is made of a polymer material.

In another embodiment of the second aspect, the at least one position hole includes a first position hole and a second position hole that correspond to different lengths of the firearm.

In another embodiment of the second aspect, the base portion and first edges of the first interface form an inverted T shape rail.

In another embodiment of the second aspect, the first interface and the second interface are created using an extrusion manufacturing process.

In another embodiment of the second aspect, the plurality of first edges of the first interface in contact with the plurality of second grooves of the second interface and the plurality of first grooves of the first interface in contact with the plurality of second edges of the second interface lock the first and second interfaces preventing the stock from moving about a radial axis of the receiver extension.

In another embodiment of the second aspect, the method further comprises receiving a body portion of the receiver extension using a first receiving wall and a second receiving wall of the stock.

In another embodiment of the second aspect, the first receiving wall and the second receiving wall expose a top portion creating an interior cavity of the stock that does not fully enclose the receiver extension.

In another embodiment of the second aspect, the stock further comprises a stock buttplate to cushion the stock when pressed again a shooter's shoulder.

In another embodiment of the second aspect, the at least one position hole includes five position holes.

In another embodiment of the second aspect, the at least one position hole includes seven position holes.

BRIEF DESCRIPTION OF THE DRAWINGS

FIG. 5 is a schematic diagram illustrating a top perspective view of a stock with a second interface in accordance with an embodiment of the invention.

DETAILED DESCRIPTION OF THE DRAWINGS

Turning now to the drawings, stock assembly systems with mating interfaces in accordance with embodiments of the invention are disclosed. In many embodiments, a stock assembly may include a receiver extension having a first interface configured to mate with a second interface of a stock. As further described below, the receiver extension may be fixed to a firearm and the stock may be securely fitted with the receiver extension while allowing the stock to slide about the receiver extension to change the length of the firearm. In various embodiments, the first interface of the receiver extension may include a base portion, first edges, and first grooves. In several embodiments, the second interface of the stock may include a slot portion, second edges, and second grooves. In many embodiments, the stock may slide along a horizontal axis of the receiver extension and be secured to a desired position utilizing an attachment pin that can be adjusted using an attachment lever.

Many varieties of stocks and receiver extensions may be utilized in accordance with embodiments of the invention by including mating interfaces, as described herein. For instance, larger and smaller varieties of stocks can be affixed to receiver extensions of varying lengths provided both components utilize a mating interface in accordance with many embodiments of the invention. In addition, varying external shapes, form factors, and material make-ups can be utilized in stocks and receiver extensions without departing from the spirit of the invention. Other embodiments can freely utilize other shapes for mating interfaces without departing from the spirit of the invention. Stock assembly systems in accordance with embodiments of the invention are further described below.

Firearms Incorporating Stock Assemblies with Mating Interfaces

Stock assemblies in accordance with embodiments of the invention can allow for securing of stocks to receiver extensions using mating interfaces. In various embodiments, the mating interfaces may include the mating of a first interface of a receiver extension to a second interface of a stock for affixing the stock to the receiver extension while allowing for the stock to slide along a horizontal axis of the receiver extension.

Figure 1:
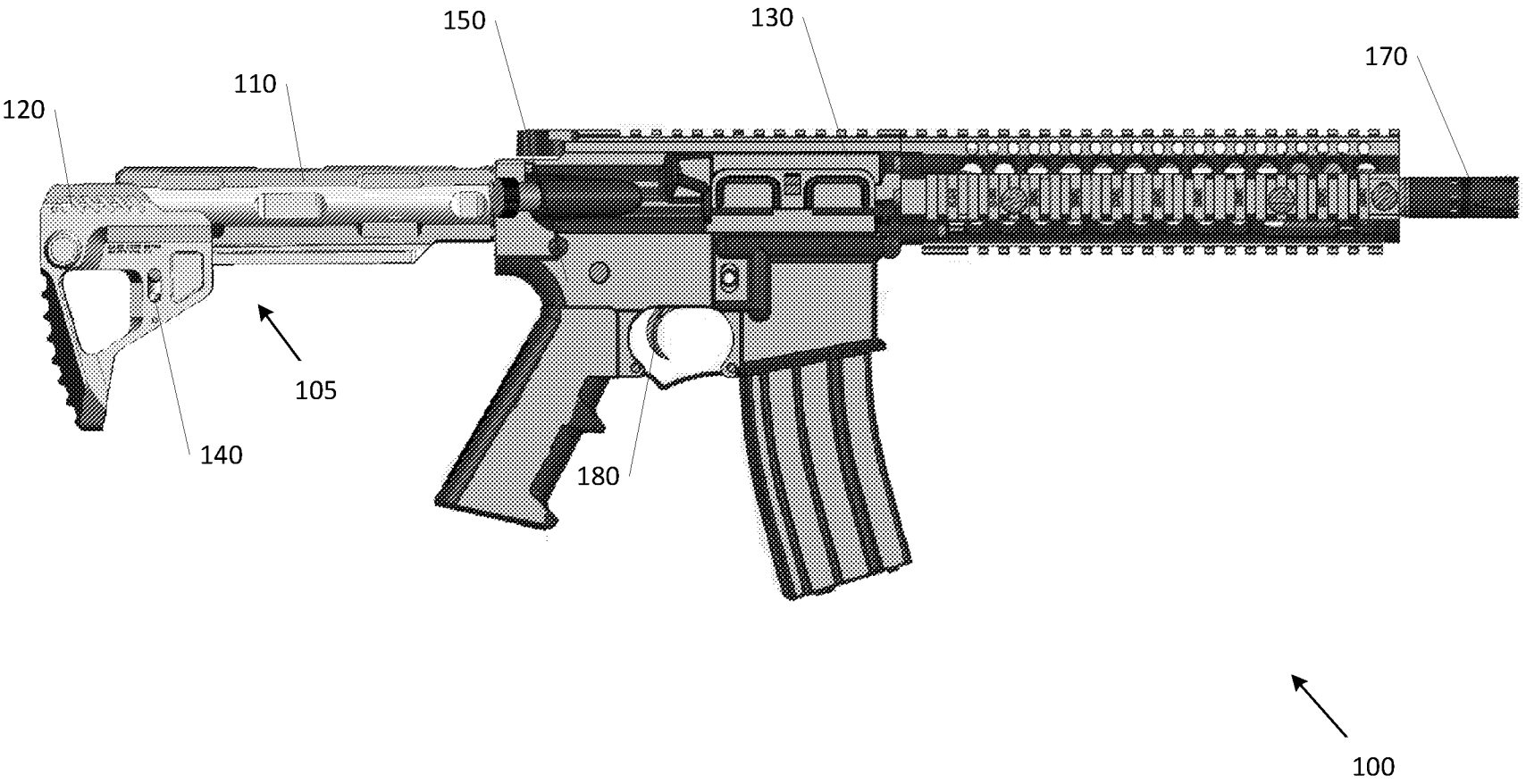
FIG. 1 is a schematic diagram illustrating a side perspective view of a firearm with a stock assembly in accordance with an embodiment of the invention.

An exemplary side perspective view of a stock assembly affixed to a firearm 100 in accordance with an embodiment of the invention is illustrated in FIG. 1. The firearm 100 may include an upper assembly 130 with a barrel 170 and a lower receiver 150 with a trigger group 180. The firearm 100 may further include a stock assembly 105 that includes a receiver extension 110 having a first interface and a stock 120 having a second interface, as further described below. In various embodiments, the receiver extension 110 may be attached to the firearm 100 via a threaded portion of the receiver extension 110. Further, the stock 120 may be affixed to the receiver extension 110 by mating the first interface of the receiver extension with the second interface of the stock, as further described below. In many embodiments, the length of the firearm 100 may be adjusted by sliding the stock 120 along a horizontal axis of the receiver extension 110 and locked into a particular position utilizing an adjustment lever 140. Once mated and locked into place, the receiver extension 110 and stock 120 combination may yield a stable and lightweight firearm of varying lengths.

In reference to FIG. 1, the firearm 100 may be a variety of semi-automatic rifles such as (but not limited to) the ArmaLite AR-15. Other embodiments of the invention can be compatible with other makes and models of firearms, such as (but not limited to) Автомат Калашникова (transliterated as Avtomat Kalashnikova) (AK) pattern rifles, shotguns, submachine guns, and/or hunting rifles. Yet still other embodiments of the invention can provide for stock assemblies with mating interfaces for firearms beyond AR and AK pattern rifles such as (but not limited to) Beretta rifles (ARX), Fabrique Nationale rifles (SCAR), Sig Sauer rifles (SIG516), Heckler & Koch (HK416), IWI (ACE), etc. Some embodiments of the invention may omit combinations of sub-components and still remain within the spirit of the invention. For example, in several embodiments, at least one of the adjustment pin, stock, and/or received extension may be omitted.

In further reference to FIG. 1, the stock assemblies may be made out of a strong polymer. Various embodiments may utilize other materials including (but not limited to) plastics, metals, and/or wood materials. Moreover, different embodiments of stock assemblies may be of different lengths and/or widths in order to function with various makes, models, and brands of firearms. Having discussed an exemplary embodiment, more detailed perspectives and further embodiments of stocks assemblies including receiver extensions with first interfaces and stocks with second interfaces are further discussed below.

Receiver Extensions with First Interfaces

Figure 2:
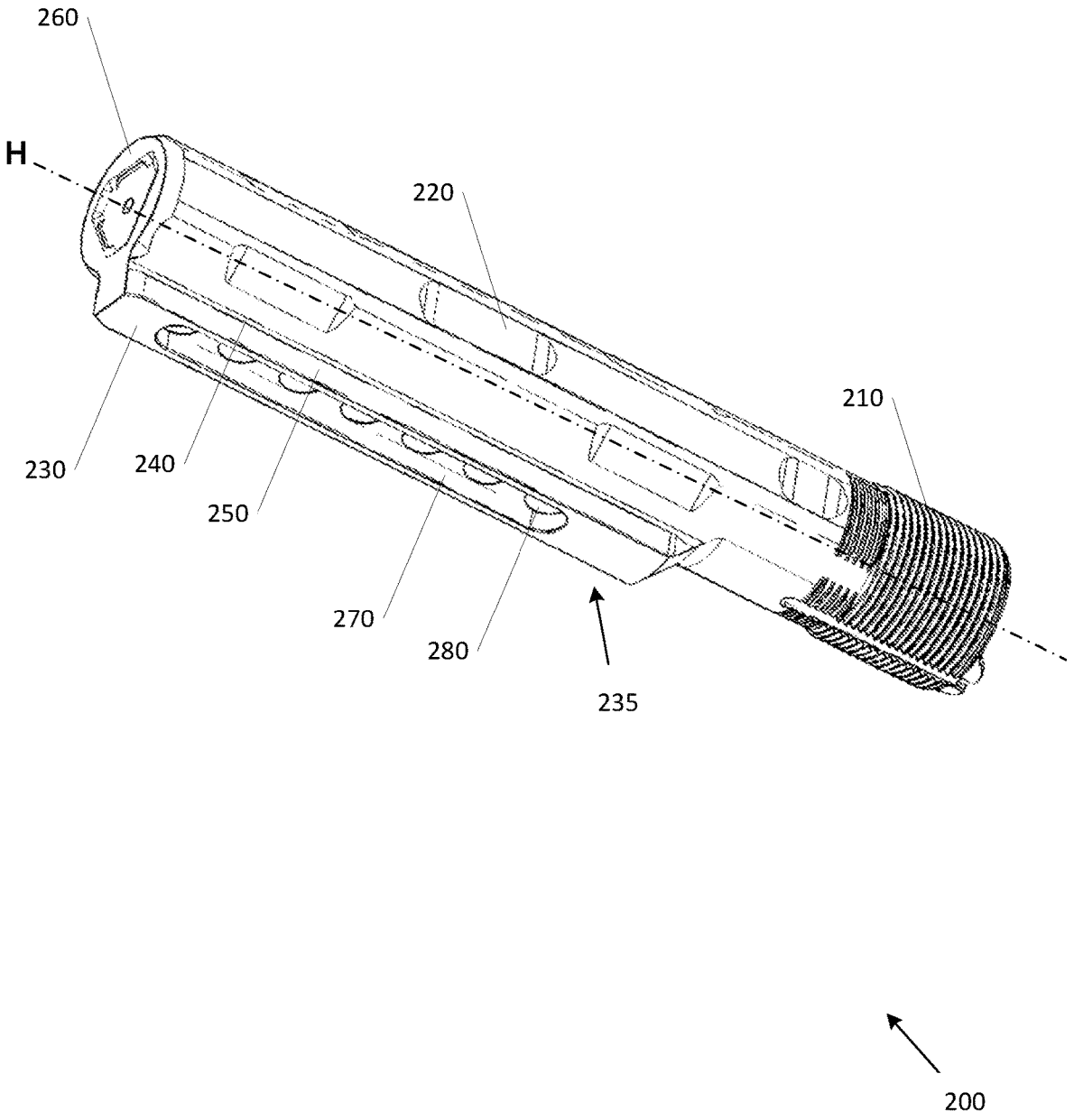
FIG. 2 is a schematic diagram illustrating a bottom perspective view of a receiver extension with a first interface in accordance with an embodiment of the invention.

Receiver extensions in accordance with embodiments of the invention may have first interfaces to allow mating with stocks having associated second interfaces. A schematic diagram illustrating a bottom perspective view of an exemplary receiver extension 200 with a first interface 235 in accordance with an embodiment of the invention is illustrated in FIG. 2. The receiver extension 200 may include a receiver connection portion 210 (e.g., a threading portion 210), extension body portion 220, and extension end portion 260. In various embodiments, the receiver threading portion 210 may be used to attach the receiver extension 200 to a firearm. For example, the receiver extension 200 may be attached to a rear of the firearm having its own threading portion that allows the receiver extension 200 to be threaded into place. In various embodiments, the receiver extension 200 may be hollow to allow recoil springs to move during the cycling of the firearm. The extension end portion 260 may also include one or more openings.

In reference to FIG. 2, the receiver extension 200 may also include a first interface 235 having a base portion 230, first grooves 240, and first edges 250. In many embodiments, the first interface 235 may be configured to mate with a second interface of a stock. For example, the base portion 230 may be configured to slide horizontally along a slot portion of the second interface, as further described below. Further, the first edges 250 may be configured to insert into second grooves of the second interface and the first grooves 240 may be configured to receive second edges of the second interface, thereby locking (may also be referred to as "mating") the first interface 235 with the second interface and preventing the stock from releasing from the receiver extension 200 radially away from the receiver extension 200. In various embodiments, the base portion 230 may also include a well 270 having one or more position holes 280 for receiving an adjustment pin of the stock and thereby locking the first interface 235 with the second interface and preventing the stock from sliding about the receiver extension 200 along a horizontal axis H of the receiver extension 200. In many embodiments, each of the position holes 280 may correspond to different adjustment position for the stock assemblies.

Figure 3:
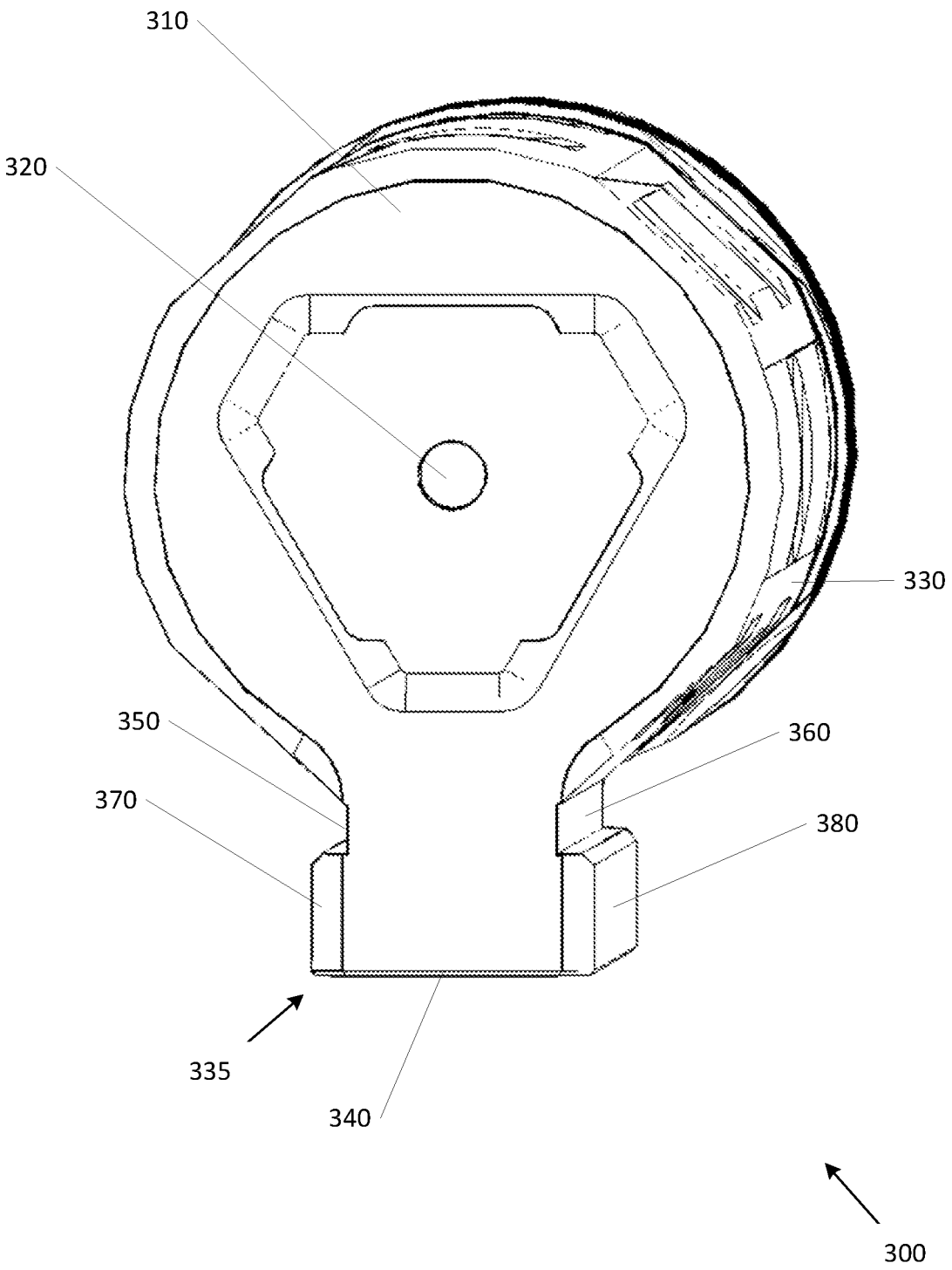
FIG. 3 is a schematic diagram illustrating a rear perspective view of a receiver extension with a first interface in accordance with an embodiment of the invention.

A schematic diagram illustrating a rear perspective view of a receiver extension 300 having a first interface in accordance with an embodiment of the invention is illustrated in FIG. 3. The receiver extension 300 may include an extension end portion 310 having an opening 320, an extension body portion 330, and a first interface 335. As described above, the first interface 335 may include a base portion 340, first grooves 350, 360, and first edges 370, 380 for mating with a second interface as described herein.

In reference to FIG. 3, the receiver extension 300 is illustrated from a direct rear perspective to emphasize an exemplary shape of the first interface 335. In various embodiments, a stock with a second interface may mate with the first interface 335 such that the stock may slide along the base portion 340, first grooves 350, 360, and first edges 370, 380. While the base portion 340, first grooves 350, 360, and the first edges 370, 380 may together form an inverted "T" shape rail, other embodiments of the invention can utilize base portions, first grooves, and the first edges, that together may form other shapes of first interfaces and still be within the spirit of the invention. For instance, other embodiments may utilize curved or rounded first edges 370, 380. In yet further embodiments, additional edges and cuts may be included in the first interface 335 along the first grooves 350, 360 and/or first edges 370, 380. In still other embodiments the base portion 340 may be altered to be of different shape and/or to include more or less material to accomplish design goals such as (but not limited to) reducing weight or shifting weight balances. In various embodiments, the first grooves 350, 360 may be identical in shape and size to each other (as illustrated) but in other embodiments, the first grooves 350, 360 may be of different shape and/or size. Likewise, the first edges 370, 380 may be identical in shape and size to each other (as illustrated) but in other embodiments, the first edges 370, 380 may be of different shape and/or size. As described above, the key interfaces may be produced via extrusion manufacturing processes that may be readily adjusted for different shapes via different extrusion dies. Thus, wide varieties of shapes of mating interfaces may be produced for both receiver extensions and for associated stocks utilizing extrusion manufacturing processes. Exemplary stocks with second interfaces in accordance with embodiments of the invention will be discussed below.

Firearm Stocks with Second Interfaces

Stocks in accordance with embodiments of the invention can have second interfaces to allow mating with first interfaces of receiver extensions. When mated, first and second interfaces can enable substantial improvements in size, grip, and/or fit over previous techniques for joining stocks to receiver extensions. The following discussion will provide examples of stocks having second interfaces in accordance with some embodiments of the invention.

Figure 4:
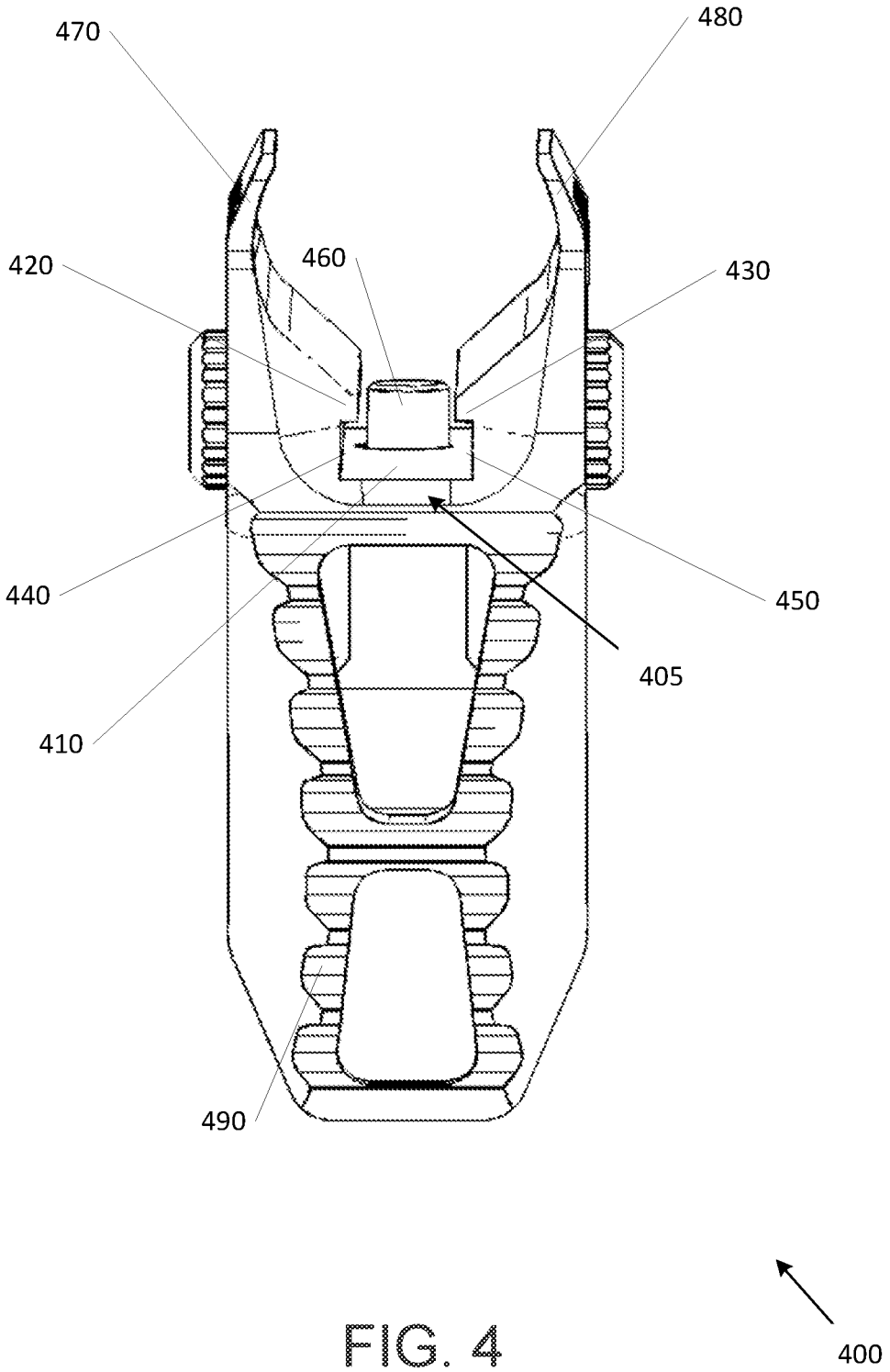
FIG. 4 is a schematic diagram illustrating a rear perspective view of a stock with a second interface in accordance with an embodiment of the invention.

A schematic diagram illustrating a rear perspective view of a stock with a second interface in accordance with an embodiment of the invention is illustrated in FIG. 4. The stock 400 may include a second interface 405 configured to mate with a first interface of a receiver extension, as described above. In various embodiments, the second interface 405 may include a slot portion 410 configured to receive a base portion of the first interface. In some embodiments, the slot portion 410 may include an adjustment pin 460 that locks into one of a plurality of position holes located within a well of the base portion of the first interface, as described above. In various embodiments, the adjustment pin 460 may be released (may also be referred to as "first position") using an adjustment lever and locked (may also be referred to as "second position") into a desired position hole preventing the stock from moving along a horizontal axis of the receiver extension and allowing the firearm to obtain a desired length. In many embodiments, the second interface 405 may also include second edges 420, 430 configured to slide along first grooves of the first interface. In several embodiments, the second interface 405 may also include second grooves 440, 450 configured to receive first edges of the first interface. In various embodiments, the mating of the second edges 420, 430 with the first grooves (e.g., first groove 350, 360) and the second grooves 440, 450 with the first edges (e.g., first edges 370, 380) may lock the first and second interfaces (e.g., first interface 335 and second interface 405) preventing the stock 400 from moving about a radial axis of the receiver extension (e.g., receiver extension 300). For example, the second edges 420, 430 of the stock may latch with corresponding first edges extruding from first interfaces of matching receiver extensions. By having such complementing overhanging edges, embodiments of the invention can provide a significantly more stable and firmer grip between receiver extensions and telescoping. Thus, the second interface 405 of the stock 400 may mate with the first interface of the receiver extension.

In further reference to FIG. 4, the stock 400 may also include a first receiving wall 470 and a second receiving wall 480 that receive the extension body portion of the receiver extension. In some embodiments, the first and second receiving walls 470, 480 may not fully enclose and expose a top portion, thereby creating an interior cavity of the stock 400 that does not fully enclose the receiver extension. In various embodiments, the first and second receiving walls 470, 480 may further support the mating between the stock 400 and the receiving extension. However, the stock 400 is typically not held in place by the first and second receiving walls 470, 480, but instead held in place by the mating between the first interface of the receiving extension and the second interface 405 of the stock 400. Thus, the first and second receiving walls 470, 480 may be manufactured with higher tolerances. Further, different embodiments may have differing sizes and shapes of first and second receiving walls 470, 480 to accommodate varying sizes and form factors of receiver extensions. In addition, a stock 400 may also include a stock buttplate 490 that may be used to cushion the stock when pressed against a shooter's shoulder. Other varieties of stock buttplates can be utilized without departing from the spirit of the invention.

A schematic diagram illustrating a top perspective view of a stock 500 with a second interface 505 in accordance with an embodiment of the invention is illustrated in FIG. 5. The stock 500 may include a slot portion 510, second edges 520, 530, second grooves 540, 550, and an adjustment pin 560. The second edges 520, 530 are shown overhanging the slot portion 510. In varying embodiments, the second edges 520, 530 and slot portions 510 may have different shapes beyond those provided as visual examples.

As described above, in some embodiments, the stocks and/or receiver extensions may be produced using extrusion manufacturing techniques whereby components are produced by forcing blank material through dies to produce a final product in the shape of the die. Several advantages of extrusion over other manufacturing processes are its ability to create specialized and particular cross-sections utilizing specified shapes of dies. In addition, extrusion manufacture process may allow for the use of materials that are brittle, because such processes typically apply compressive and shear stresses. Further, extrusion manufacture processes can also produce products with improved surface finishes over alternative means of manufacture. The interfaces such as the mating of the first interface of the receiver extension 300 of FIG. 3 and second interface of the stock 400 of FIG. 4 can demonstrate some features of extrusion manufacture. For example, the first and second edges, first and second grooves, the base portion, and the slot portion, may have smooth and level surfaces using extrusion manufacture processes. In addition, the surfaces of the first interface and the second interface may be designed with very tight tolerances to enable a firm fit when mating the first and second interfaces. In contrast, traditional stock and receiver extension combinations often need to be produced with looser tolerances as stamping manufacture techniques cannot produce the precise components produced with extrusion manufacture processes. Moreover, the many alternative shapes of various embodiments of the keyed interfaces may readily be produced by altering dies in the extrusion manufacture process. Keyed interfaces including a first interface of a receiver extension mated to a second interface of a stock in accordance with embodiments of the invention are further described below.

Stock Assemblies with Mating Interfaces

A stock and a receiver extension can be securely affixed by mating a first interface of a receiver extension with a second interface of a stock. As described above, such mating interfaces can provide advantages over prior techniques including (but not limited to) more securely affixing of a stock to a receiver extension, reduced weight, reduced parts count, reduced overall size, and higher part tolerances.

Figure 6:
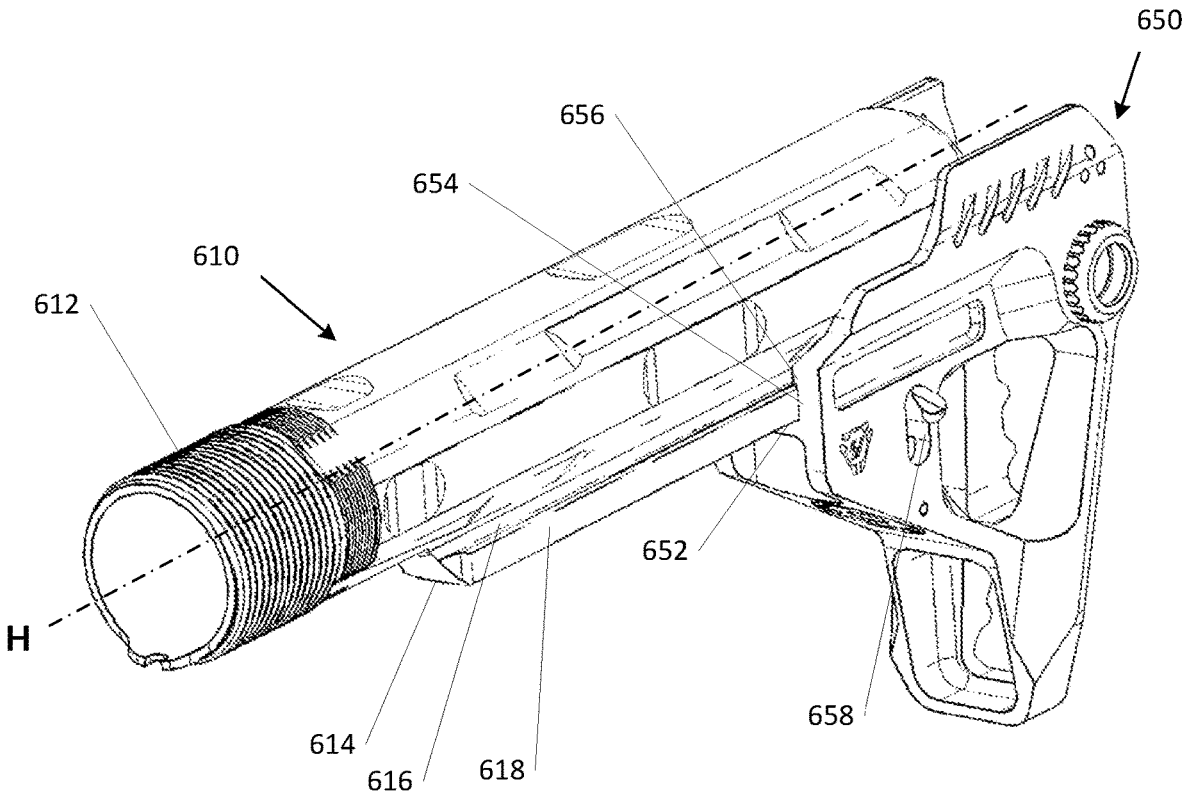
FIG. 6 is a schematic diagram illustrating a front perspective view of a stock assembly in accordance with an embodiment of the invention.

A schematic diagram illustrating a front perspective view of a stock assembly 600 with mating interfaces in accordance with an embodiment of the invention is illustrated in FIG. 6. The stock assembly 600 may include a receiver extension 610 and a stock 650. The receiver extension 610 may include receiver extension threading portion 612 and a first interface including a base portion 614, first grooves 616, and first edges 618 (only one side is shown). The stock 650 may include a complementary second interface including a slot portion 652, second grooves 654, and second edges 656 (only one side is shown).

In various embodiments, the receiver extension 610 may be attached to the firearm using the extension threading portion 612, as described above. In many embodiments, the stock 650 may be joined to receiver extension 610 by mating the first interface with the second interface, as described below. For example, the first and second interfaces may mate by engaging and sliding the base portion 614 along the slot portion 652, the first edges 618 along the second grooves 654, and the first grooves 616 along the second edges 656. By mating the first and second interfaces, the stock assembly may only move along a horizontal axis H of the receiver extension along the mated interface. To lock the stock into a fixed position along the horizontal axis H, the stock 650 may also include an adjustment pin that may be engaged or disengaged using an adjustment lever 658. For example, when the adjustment lever 658 is depressed, then the adjustment pin may lift out from one of a plurality of position holes of the receiver extension, as described further below.

Figure 7:
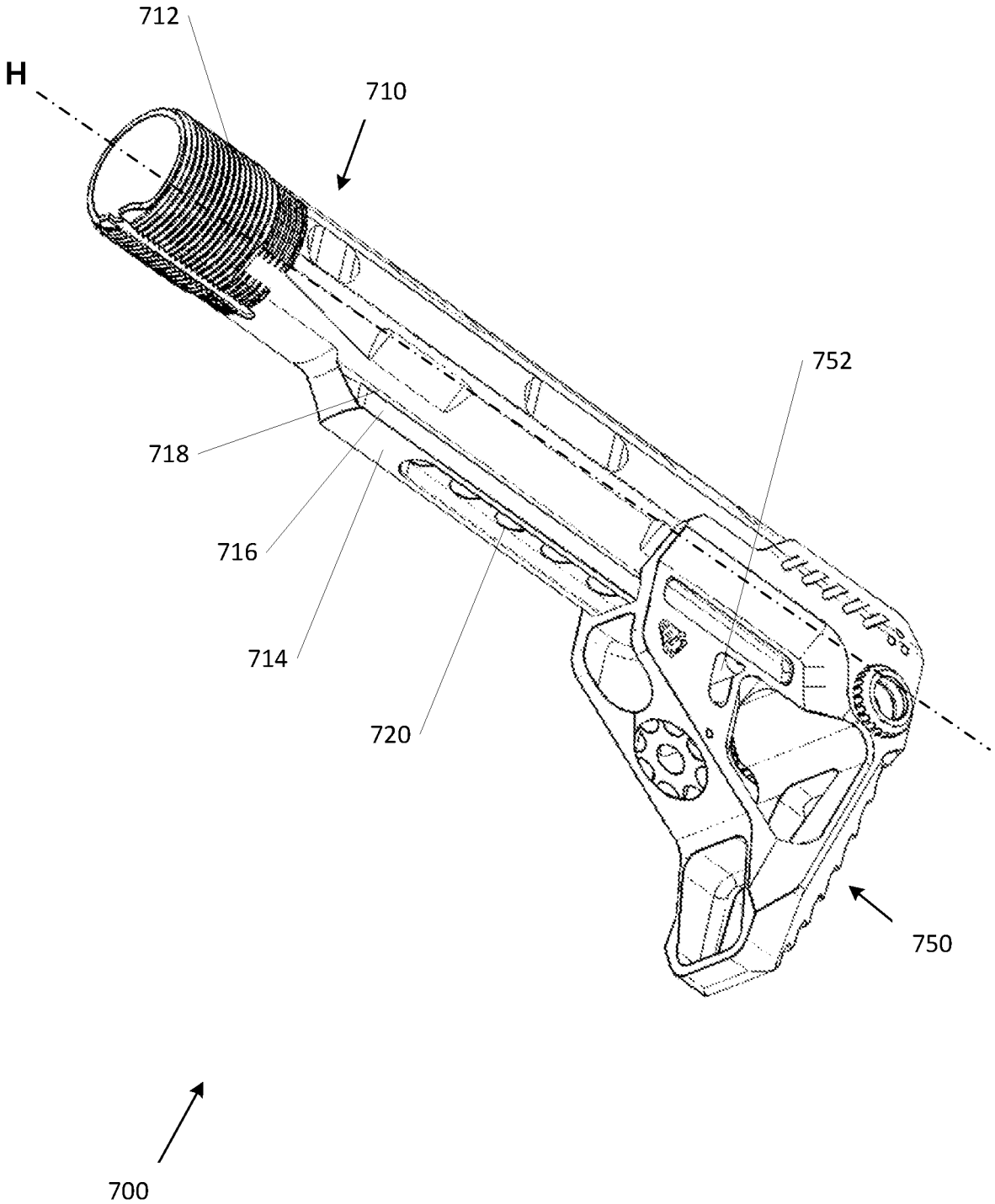
FIG. 7 is a schematic diagram illustrating a bottom perspective view of a stock assembly in accordance with an embodiment of the invention.

A schematic diagram illustrating a bottom perspective view of a stock assembly 700 with mating interfaces in accordance with an embodiment of the invention is illustrated in FIG. 7. As described above, a stock 750 may be locked into place along a horizontal axis H of a receiver extension 710. As illustrated, the receiver extension 710 may include an extension threading portion 712, a base portion 714, first grooves 718, and first edges 716 (only one side shown). In various embodiments, the base portion 714 may include a well exposing a plurality of position holes 720 that facilitate locking of the stock 750 to various positions. The stock 750 may include an adjustment pin that may be locked or unlocked using an adjustment lever 752. As described above, the stock 750 may engage with the receiver extension 710 by mating the first interface of the receiver extension 710 with the second interface of the stock 750. Once the first and second interfaces are mated, the position of the stock 750 may be adjusted based on the locking of the adjustment pin to one of the plurality of position holes 720. For example, if the adjustment pin is locked with a position hole 720 closer to the extension threading portion 712, then the firearm would take on a shorter length compared to if the adjustment pin is locked with a position hole 720 further away from the extension threading portion 712. In various embodiments, the receiver extension 710 may include any number of position holes 720 including (but not limited to) five or seven position holes. In many embodiments, the adjustment pin may be locked or unlocked by depressing the adjustment lever 752. Thus, upon depression of the adjustment lever 752, the stock 750 may slide into different positions along the receiver extension 710 and thereby adjusting the length of the firearm. By releasing the adjustment lever 752, the stock 750 may lock into place. In various embodiments, the adjustment lever 752 may include one or more springs to facilitate its operation. However, any mechanism known to one of ordinary skill in the art may be utilized to lock the stock 750 along the horizontal axis H of the receiver extension 710.

Figure 8:
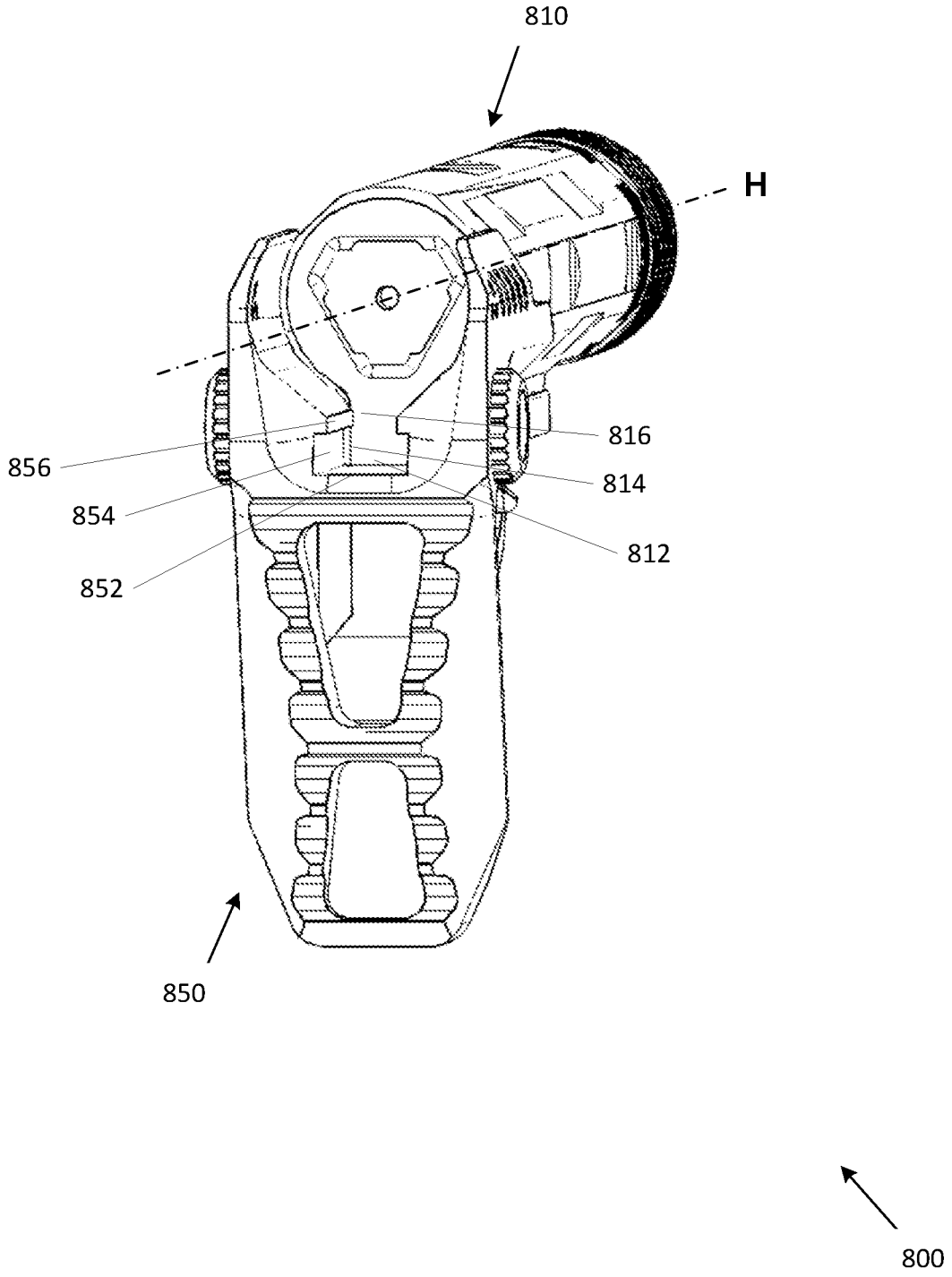
FIG. 8 is a schematic diagram illustrating a rear perspective view of a stock assembly in accordance with an embodiment of the invention.

A schematic diagram illustrating a rear perspective view of a telescoping stock 800 with mating interfaces in accordance with an embodiment of the invention is illustrated in FIG. 8. The stock assembly 800 may include a receiver extension 810 having a first interface and a stock 850 having a second interface. In many embodiments, the second interface of the stock may include a slot portion 852 configured to mate with a base portion 812 of the first interface. In several embodiments, the second interface may include second grooves 854 configured to mate with first edges 814 of the first interface. In various embodiments, the second interface may include second edges 856 configured to mate with first grooves 816 of the first interface. Upon mating of the first and second interfaces, the stock 850 may slide along a horizontal axis H of the receiver extension 810 thereby changing the length of the firearm, as described above.

The examples shown in FIGS. 2-8 are illustrative examples of several embodiments of the invention. Further embodiments of the invention may include stock assemblies with mating interfaces of varying form factors to accommodate different makes, models, and brands of receiver extensions, stocks, and/or firearms. Alternative embodiments may include longer, shorter, thinner, and/or shallower varieties of stock assemblies including stocks and receiver extensions without departing from the spirit of the invention. In addition, components of the first and second interfaces may be omitted and still remain within the spirit of the invention. For instance, where a receiver extension is described as having a first interface, one or more of a base portion, first grooves, first edges, and/or position holes may be omitted in various embodiments. Further, where a stock is described as having a second interface, one or more of a slot portion, second grooves, second edges, adjustment pin, may be omitted in other embodiments. Moreover, different quantities of the first and second interface components may be included without departing from the spirit of the invention. For example, in some embodiments, the first interface may include only one first edge and one first groove so long as the mating second interface also includes only one second groove and one second edge. Further, in some embodiments, the first interface may include a base portion that is not flat so long as the mating second interface also includes a slot portion that may receive the base portion.

Processes for Installing Stock Assemblies

Figure 9:
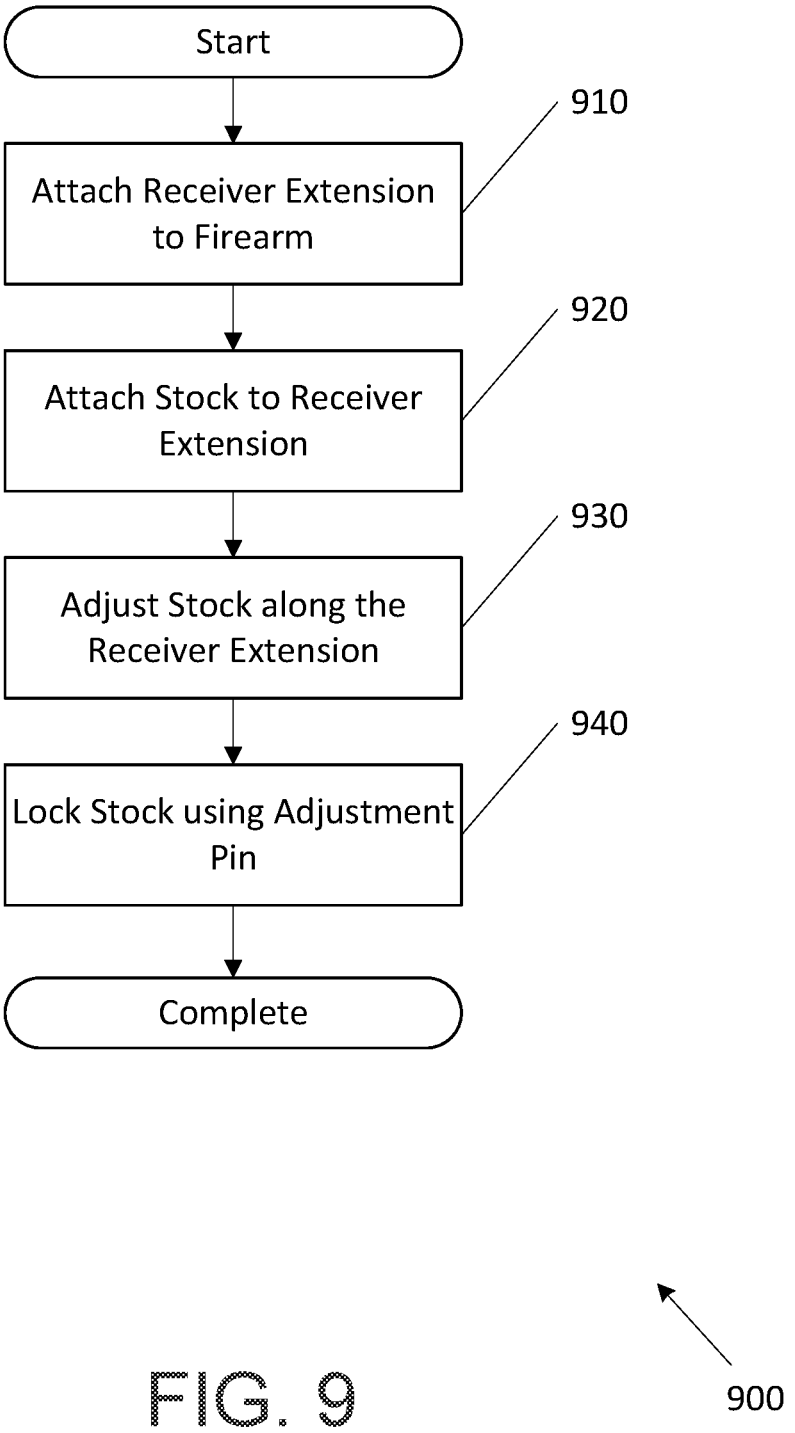
FIG. 9 is a flowchart illustrating a process for attaching a stock assembly to a firearm in accordance with an embodiment of the invention.

A flowchart illustrating a process for attaching stock assemblies with mating interfaces to a firearm in accordance with an embodiment of the invention is illustrated in FIG. 9. Stock assemblies in accordance with embodiments of the invention provide an easy to install and non-destructive method for changing the length of firearms. The process 900 may include attaching (910) a receiver extension to the firearm. In various embodiments, the receiver extension may be attached to a lower receiver of the firearm using an extension threading portion of the receiver extension, as described above. In various embodiments, the receiver extension may be attached to the firearm using additional parts such as (but not limited to) nuts, screws, rings, extension castle nuts, extended end plate, quick detach (QD) end plate, etc. The process 900 may further include attaching (920) the stock to the receiver extension by mating the first interface of the receiver extension to the second interface of the stock, as described above. The mating of the first interface and the second interface limits the stock from moving except along a horizontal axis of the receiver extension, as described above. Once attached, the process 900 may further include adjusting (930) the stock along the horizontal axis of the receiver extension and locking (940) the stock into place on the horizontal axis of the receiver extension using a stock adjustment pin, as described above. By unlocking, moving the stock, and locking the adjustment pin into one of a plurality of position pins of the receiver extension, the firearm may take on varying lengths.

While the above description contains many specific embodiments of the invention, these should not be construed as limitations on the scope of the invention, but rather as an example of one embodiment thereof. It is therefore to be understood that the present invention may be practiced otherwise than specifically described, without departing from the scope and spirit of the present invention. Thus, embodiments of the present invention should be considered in all respects as illustrative and not restrictive.

What is claimed is:

1. A stock assembly for adjusting a length of a firearm, comprising:

a receiver extension having a connecting portion configured to attach to the firearm, the receiver extension further having a first interface protruding radially on a first side of the receiver extension; and a stock having a second interface configured to slidingly mate with the first interface, wherein, when the receiver extension and the stock are assembled together with the first interface mated with the second interface, a second side of the receiver extension opposite the first side thereof is exposed and not covered by the stock.

2. The stock assembly of claim 1, wherein the connecting portion of the receiver extension is a threading portion that allows the receiver extension to be threaded with a corresponding threading portion of the firearm.

3. The stock assembly of claim 1, wherein the receiver extension is hollow to allow recoil springs to move during a cycling of the firearm.

4. The stock assembly of claim 1, wherein the receiver extension includes an extension end portion positioned opposite the connecting portion, wherein the extension end portion includes at least one opening.

5. The stock assembly of claim 1, wherein the first interface of the receiver extension comprises a base portion having at least one position hole, a plurality of first edges, and a plurality of first grooves, wherein the second interface of the stock comprises a slot portion having an adjustment pin configured to move between a first position and a second position, the second interface further comprises a plurality of second edges and a plurality of second grooves, wherein the plurality of first edges of the first interface are in contact with the plurality of second grooves of the second interface and the plurality of first grooves of the first interface are in contact with the plurality of second edges of the second interface to mate the stock with the receiver extension, and wherein the base portion of the first interface is in contact with the slot portion of the second interface allowing the stock to slide along a horizontal axis of the receiver extension.

6. The stock assembly of claim 5, wherein the first position of the adjustment pin allows the stock to slide along the horizontal axis of the receiver extension to adjust the length of the firearm.

7. The stock assembly of claim 5, wherein the second position of the adjustment pin inserts the adjustment pin into the at least one position hole to lock the stock along the horizontal axis of the receiver extension to fix the length of the firearm.

8. The stock assembly of claim 5, wherein the adjustment pin is configured to be placed into the first position or the second position using an adjustment lever.

9. The stock assembly of claim 8, wherein depressing the adjustment lever places the adjustment pin into the first position and releasing the adjustment lever places the adjustment pin into the second position.

10. The stock assembly of claim 8, wherein the adjustment lever includes at least one spring.

11. The stock assembly of claim 1, wherein the stock assembly is made of a polymer material.

12. The stock assembly of claim 5, wherein the at least one position hole includes a first position hole and a second position hole that correspond to different lengths of the firearm.

13. The stock assembly of claim 5, wherein the base portion and first edges of the first interface form an inverted T shape rail.

14. The stock assembly of claim 1, wherein the first interface and the second interface are created using an extrusion manufacturing process.

15. The stock assembly of claim 5, wherein the plurality of first edges of the first interface in contact with the plurality of second grooves of the second interface and the plurality of first grooves of the first interface in contact with the plurality of second edges of the second interface lock the first and second interfaces preventing the stock from moving about a radial axis of the receiver extension.

16. The stock assembly of claim 1, wherein the stock further comprises a first receiving wall and a second receiving wall that receives a body portion of the receiver extension.

17. The stock assembly of claim 16, wherein the first receiving wall and the second receiving wall expose a top portion creating an interior cavity of the stock that does not fully enclose the receiver extension.

18. The stock assembly of claim 1, wherein the stock further comprises a stock buttplate to cushion the stock when pressed again a shooter's shoulder.

19. The stock assembly of claim 5, wherein the at least one position hole includes five position holes.

20. The stock assembly of claim 5, wherein the at least one position hole includes seven position holes.

* * * * *